US011319918B2

(12) United States Patent
Kita et al.

(10) Patent No.: US 11,319,918 B2
(45) Date of Patent: May 3, 2022

(54) INTERNAL COMBUSTION ENGINE IGNITION DEVICE

(71) Applicant: HITACHI AUTOMOTIVE SYSTEMS, LTD., Hitachinaka (JP)

(72) Inventors: Masato Kita, Hitachinaka (JP); Yoichiro Kobayashi, Hitachinaka (JP)

(73) Assignee: HITACHI ASTEMO, LTD., Ibaraki (JP)

( * ) Notice: Subject to any disclaimer, the term of this patent is extended or adjusted under 35 U.S.C. 154(b) by 137 days.

(21) Appl. No.: 16/755,996

(22) PCT Filed: Jan. 8, 2019

(86) PCT No.: PCT/JP2019/000145
§ 371 (c)(1),
(2) Date: Apr. 14, 2020

(87) PCT Pub. No.: WO2019/146393
PCT Pub. Date: Aug. 1, 2019

(65) Prior Publication Data

US 2020/0256306 A1 Aug. 13, 2020

(30) Foreign Application Priority Data

Jan. 23, 2018 (JP) ..... JP2018-008856

(51) Int. Cl.
*F02P 3/00* (2006.01)
*F02P 3/055* (2006.01)

(52) U.S. Cl.
CPC ..... *F02P 3/055* (2013.01)

(58) Field of Classification Search
None
See application file for complete search history.

(56) References Cited

U.S. PATENT DOCUMENTS 3,430,615 A * 3/1969 Chavis ..... G01P 1/103 123/335
3,675,635 A * 7/1972 Graser ..... F02P 7/0675 123/617

(Continued)

FOREIGN PATENT DOCUMENTS

CN 1123880 A 6/1996
JP 5765689 B2 8/2015

OTHER PUBLICATIONS

Chinese Office Action dated Jun. 28, 2021 for Chinese Patent Application No. 201980005479.9.

*Primary Examiner* — Phutthiwat Wongwian
*Assistant Examiner* — Sherman D Manley
(74) *Attorney, Agent, or Firm* — Volpe Koenig

(57) ABSTRACT

Provided is an internal combustion engine ignition device capable of preventing an output signal level of a drive circuit from changing sharply when shifting from a normal ignition operation mode to a protection operation mode while reducing the cost of dedicated components and the like. An internal combustion engine ignition device of the present invention includes a first differential circuit for outputting a drive signal in a first mode and a second differential circuit for outputting a drive signal in a second mode, where the first differential circuit and the second differential circuit each include a transistor and are configured such that a drive current for supplying the drive signal flows through the transistor which is common between the first mode and the second mode.

18 Claims, 12 Drawing Sheets

(56) References Cited

U.S. PATENT DOCUMENTS

| | | | | | | |
|---|---|---|---|---|---|---|
| 3,699,940 | A | * | 10/1972 | Vargas | F02P 3/0884 | 123/598 |
| 3,989,024 | A | * | 11/1976 | Lai | F02P 3/0456 | 123/609 |
| 4,131,100 | A | * | 12/1978 | Merrick | F02P 15/10 | 123/598 |
| 4,138,982 | A | * | 2/1979 | Hattori | F02P 5/1551 | 123/406.66 |
| 4,196,711 | A | * | 4/1980 | Daumer | F02P 3/051 | 123/644 |
| 4,217,874 | A | * | 8/1980 | Sohner | F02P 7/067 | 123/617 |
| 4,268,888 | A | * | 5/1981 | Bodig | F02P 7/067 | 123/406.59 |
| 4,382,431 | A | * | 5/1983 | Bodig | F02P 3/051 | 123/644 |
| 4,487,183 | A | * | 12/1984 | Petrie | F02P 5/1558 | 123/406.59 |
| 5,517,962 | A | * | 5/1996 | Ling | F02P 9/005 | 123/335 |
| 5,936,830 | A | * | 8/1999 | Rousseau | F02P 15/003 | 361/253 |

* cited by examiner

INTERNAL COMBUSTION ENGINE IGNITION DEVICE

TECHNICAL FIELD

The present invention relates to a device for igniting an internal combustion engine.

BACKGROUND ART

An internal combustion engine ignition device is equipped with a protection circuit which cuts off a current in order to prevent an ignition coil and a switching element of an ignition coil primary-side current from being destroyed by an overcurrent. The protection circuit generally has two modes of operation: (a) Soft-off mode in which a coil primary-side current is gently reduced so that an abnormally high voltage is not generated in an ignition coil secondary side by a cut-off operation after the coil primary-side current has been conducted for a long time, and (b) Current limiting mode in which the switching element is controlled to reduce the coil primary-side current.

PTL 1 (Japanese Patent No. 5765689) described below discloses a technique relating to a soft-off mode. In the technique described in the PTL 1 (Japanese Patent No. 5765689), when a long conduction detection circuit detects a long conduction time longer than a predetermined time when the switching element is in a conductive state, a discharge current is output from a soft-off capacitor and the switching element is gradually transitioned from the conductive state to a cut-off state, in such a manner that the soft-off mode is realized.

CITATION LIST

Patent Literature

PTL 1: Japanese Patent No. 5765689

SUMMARY OF INVENTION

Technical Problem

When transitioning from a normal ignition operation to a protection circuit operation such as a soft-off mode or a current limiting mode, it is desirable to make a gradual transition of a conduction state of a switching element in order to prevent unintended ignition from occurring. For example, when the switching element is an IGBT, it is necessary to make a gradual transition of a gate voltage.

The technique described in PTL 1 (Japanese Patent No. 5765689) uses a capacitive element to generate a soft-off waveform. It is considered that when shifting from the normal ignition operation to the soft-off operation, the capacitive element absorbs switching noise and prevents a sharp change in the gate voltage of the switching element (IGBT). However, (a) the capacitive element is required exclusively for soft-off and this increases the cost, and (b) the soft-off waveform is determined by the value of the capacitive element and the IGBT gate input resistance or the gate input capacitance, and thus problems such as a large load dependency and requirements of an adjustment cost for this can be conceivable.

The invention is made in view of the problems described above and is to provide an internal combustion engine ignition device capable of preventing an output signal level of a drive circuit from changing sharply when shifting from a normal ignition operation mode to a protection operation mode while reducing the cost of dedicated parts and the like.

Solution to Problem

An internal combustion engine ignition device of the invention includes a first differential circuit for outputting a drive signal in a first mode and a second differential circuit for outputting a drive signal in a second mode, where the first differential circuit and the second differential circuit each include a transistor and are configured such that a drive current for supplying the drive signal flows through the transistor which is common between the first mode and the second mode.

Advantageous Effects of Invention

According to the internal combustion engine ignition device of the invention, when switching from a normal operation mode to a protection operation mode, an output signal level of a drive signal can be gently switched. Problems, configurations, and effects other than those described above will be apparent from the following description of embodiments.

DESCRIPTION OF EMBODIMENTS

First Embodiment

Figure 1:
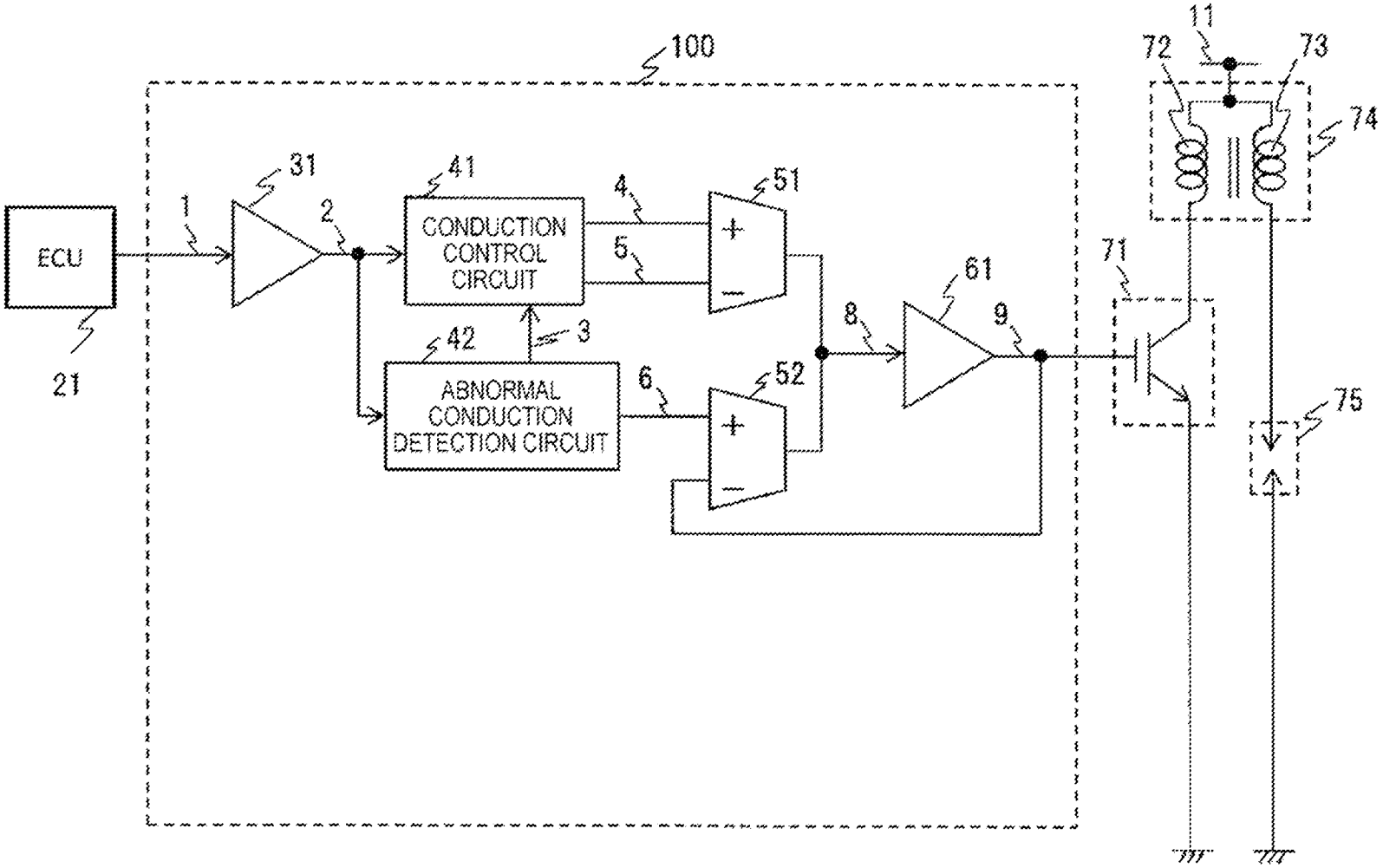
FIG. 1 is a configuration diagram of an internal combustion engine ignition device according to a first embodiment.

FIG. 1 is a configuration diagram of an internal combustion engine ignition device according to a first embodiment of the present invention. The internal combustion engine ignition device includes an electronic control unit (ECU) 21, an ignition control device 100, a battery 11, a switching element 71, an ignition coil 74 (a primary-side coil 72, a secondary-side coil 73), and an ignition plug 75. The ignition control device 100 further includes an input buffer circuit 31, a conduction control circuit 41, an abnormal conduction detection circuit 42, a differential circuit 51, a differential circuit 52, and a drive circuit 61.

The switching element 71 ignites the internal combustion engine by outputting a drive signal to the ignition coil 74. The switching element 71 is driven by inputting a drive signal output from the ignition control device 100 to a gate terminal.

The ECU 21 instructs the ignition control device 100 to ignite the internal combustion engine. The conduction control circuit 41 is a circuit which outputs a conduction control signal to the switching element 71 in the normal ignition mode. The abnormal conduction detection circuit 42 detects that the switching element 71 has been conducted for a longer time than during the normal operation (abnormal conduction). When detecting the abnormal conduction, the abnormal conduction detection circuit 42 notifies the conduction control circuit 41 of the detection. The conduction control circuit 41 stops the conduction control signal, and thereafter, the abnormal conduction detection circuit 42 outputs a conduction control signal to the switching element 71 to execute a soft-off mode.

The differential circuits 51 and 52 are circuits which amplify the difference between two input signals. The differential circuit 51 outputs a drive signal in the normal ignition mode and the differential circuit 52 outputs a drive signal in the soft-off mode. The differential circuit 51 amplifies the difference between the two conduction control signals received from the conduction control circuit 41. The differential circuit 52 amplifies the difference between the conduction control signal received from the abnormal conduction detection circuit 42 and the signal fed back from the output of the drive circuit 61. Specific examples of the differential circuits 51 and 52 and the drive circuit 61 will be described below.

Figure 2:
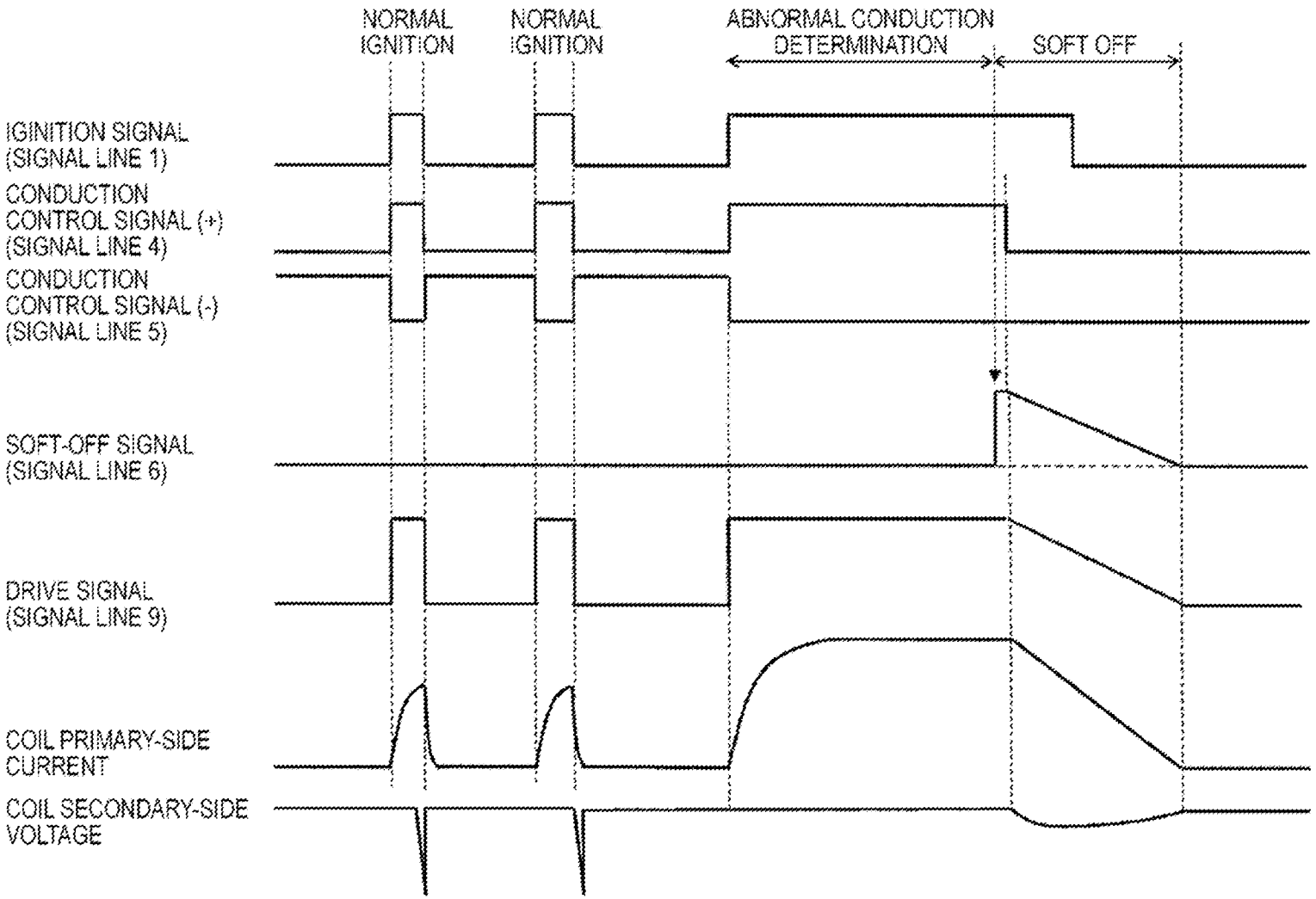
FIG. 2 is a timing chart illustrating an operation of an ignition control device 100.

FIG. 2 is a timing chart illustrating an operation of the ignition control device 100. Here, signal waveforms on main signal lines are illustrated. Hereinafter, the operation in each of the normal ignition mode and the soft-off mode will be described with reference to the signal waveforms of FIG. 2.

In the normal ignition mode, a conduction control signal is input from the ECU 21 via the signal line 1. The conduction control signal is output as a drive signal to the switching element 71 via the input buffer circuit 31, the conduction control circuit 41, the differential circuit 51, the drive circuit 61, and a signal line 9. The switching element 71 operates according to the drive signal.

In the differential circuit 51, a signal line 4 is connected to the (+) terminal and a signal line 5 is connected to the (−) terminal. When the signal line 4 is a Hi level signal and the signal line 5 is a Low level signal, the signal line 9 output from the drive circuit 61 is at the Hi level and the switching element 71 is turned on. When the signal line 4 is a low level signal and the signal line 5 is a high level signal, the signal line 9 is at a low level and the switching element 71 is turned off. When the switching element 71 is turned on, current flows through the primary coil 72 of the ignition coil 74. At the same time when the switching element 71 is turned off, a primary voltage is generated in the primary-side coil 72 and a secondary voltage corresponding to the turns ratio is generated in the secondary coil 73 by mutual induction. The secondary voltage is supplied to the ignition plug 75, which ignites the internal combustion engine.

The abnormal conduction detection circuit 42 detects when the conduction time of the switching element 71 becomes longer than a predetermined time (abnormal conduction). When the abnormal conduction detection circuit 42 detects abnormal conduction, the ignition control device 100 shifts from the normal ignition mode to the soft-off mode. In the soft-off mode, the drive signal for the gate terminal of the switching element 71 is gradually changed from the Hi level to the Low level. This causes the switching element 71 to gradually transition from the conductive state to the cutoff state.

Before the transition to the soft-off mode, since the switching element 71 is in the conducting state, the signal line 4 is at the Hi level, the signal line 5 is at the Low level, a signal line 6 is at the Low level, and the signal line 9 outputs the Hi level signal. When detecting the abnormal conduction, the abnormal conduction detection circuit 42 outputs a signal waveform in the soft-off mode from the signal line 6. The signal waveform in the soft-off mode gradually changes from the Hi level to the Low level.

The soft-off signal from the signal line 6 is input to the (+) terminal of the differential circuit 52. The signal line 9 (the output of the drive circuit 61) is negatively fed back to the (−) terminal of the differential circuit 52. That is, a waveform following the waveform of the signal line 6 is fed back to the differential circuit 52 via the signal line 9.

The conduction control circuit 41 receives the detection of abnormal conduction from the abnormal conduction detection circuit 42 a signal line 3. Upon receiving the signal, the conduction control circuit 41 changes the signal line 4 from the Hi level to the Low level and keeps the signal line 5 at the Low level. By setting the timing at which the signal line 4 changes from the Hi level to the Low level after the signal line 6 has changed to the Hi level (that is, shifted to the soft-off mode), the signal line 9 remains at the Hi level. Thereby, when shifting from the normal ignition mode to the soft-off mode, the operation mode shifts smoothly without the drive signal level changing sharply.

Figure 3A:
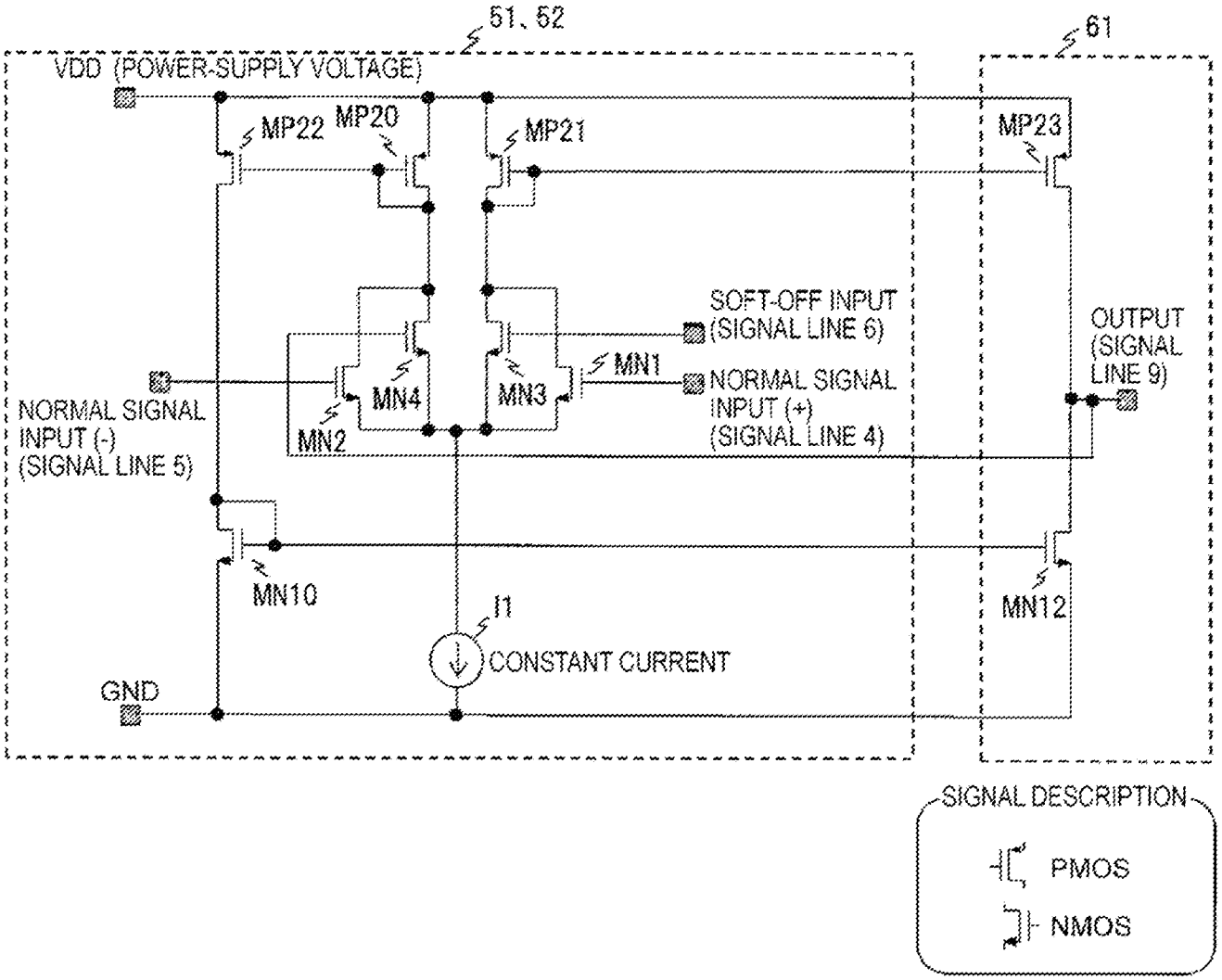
FIG. 3A is a circuit diagram of a differential circuit 51, a differential circuit 52, and a drive circuit 61.

FIG. 3A is a circuit diagram of the differential circuit 51, the differential circuit 52, and the drive circuit 61. Hereinafter, the configurations of those circuits will be described with reference to FIG. 3A.

The differential circuit 51 includes a constant current source I1, NMOS (MN1, MN2), and PMOS (MP20, MP21). The differential circuit 52 includes the constant current source I1, NMOS (MN3, MN4), and PMOS (MP20, MP21). The constant current source I1 and the PMOS (MP20, MP21) are shared between the differential circuits 51 and 52.

The drive circuit 61 includes the MP23 and the MN12. The output current from the MP23 is obtained by mirroring the output current on the differential circuit (+) terminal side based on the current mirror ratio from the MP21 to the MP23. The output current from the MN12 is obtained by mirroring the output current on the differential circuit (−) terminal side based on the current mirror ratio from the MP20 to the MP22 and the current mirror ratio from the MN10 to the MN12. The output (signal line 9) of the drive circuit 61 is negatively fed back to the (−) terminal of the differential circuit 52.

Figure 3B:
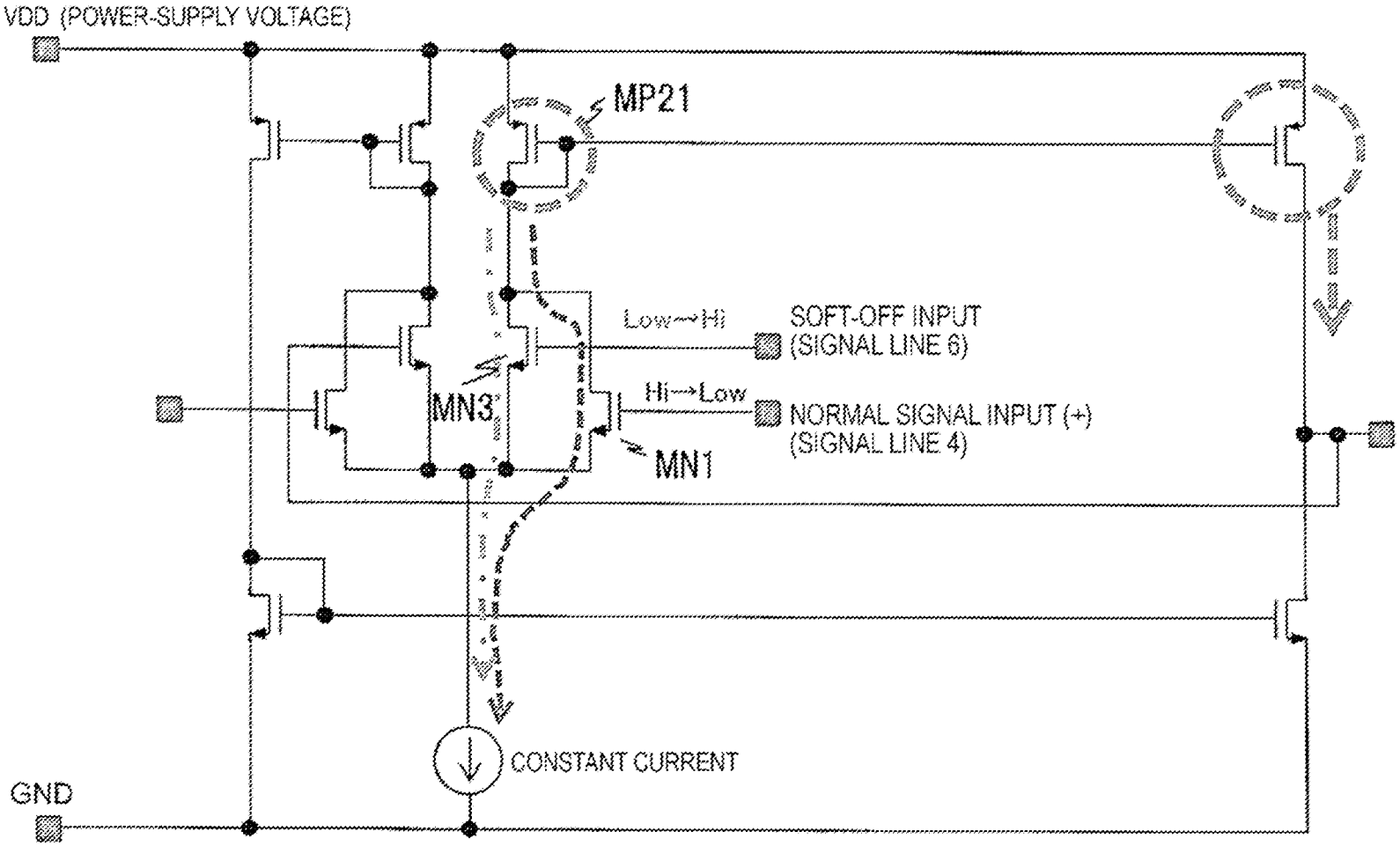
FIG. 3B is a diagram illustrating a smooth transition from a normal ignition mode to a soft-off mode.

FIG. 3B is a diagram illustrating a smooth transition from the normal ignition mode to the soft-off mode. A thick dotted line in FIG. 3B indicates that the output of the drive circuit 61 is formed by the current mirror between the MP21 and the MP23. The dotted line in FIG. 3B illustrates the current path in the normal ignition mode. An alternate long and short dash line in FIG. 3B indicates a current path in the soft-off mode.

Before shifting to the soft-off mode, the signal line 4 input to the (+) terminal of the differential circuit 51 is at the Hi level and the signal line 6 input to the (+) terminal of the differential circuit 52 is at the Low level, and thus the MN1 is turned on and the MN3 is turned off. The current flowing to the MP21 flows through the MN1.

When the mode shifts to the soft-off mode, first, the signal line 6 becomes Hi level, so that the MN1 and MN3 are turned on, but the current flowing to the MP21 does not change due to the operation of the constant current source I1. Subsequently, the MN1 is turned off and the MN3 is turned on. The current flowing to the MP21 flows through the MN3. Even during this period, the current flowing to the MP21 does not change due to the operation of the constant current source I1. Since the output of the drive circuit 61 is formed by a current mirror between the MP21 and the MP23, the current flowing to the MP23 does not change unless the current flowing to the MP21 changes. Thus, in the process of shifting from the normal ignition mode to the soft-off mode, the mode can be switched smoothly without rapidly changing the output current of the drive circuit 61.

First Embodiment: Summary

When switching from the normal ignition mode to the soft-off mode, the internal combustion engine ignition device according to the first embodiment flows the current through the MP21 common to both modes. Since the drive current is generated by the current mirror between the MP21 and the MP23, the drive current does not change sharply at the timing of mode switching. Thereby, the operation mode can be switched smoothly.

The internal combustion engine ignition device according to the first embodiment feeds back the output of the drive circuit 61 as the negative terminal input of the differential circuit 52. Thus, the output of the drive circuit 61 can be formed following the input signal to the differential circuit 52 in the soft-off mode. That is, a drive signal that follows an input signal to the differential circuit 52 can be output without depending on the load of the drive circuit 61.

In the first embodiment, since the input terminal conditions of the switching element 71 are various, it is necessary to optimize the load driving capability of the drive circuit 61. In the first embodiment, since the drive signal is generated by current mirroring the current flowing through the differential circuit 51 or 52, the drive circuit 61 can be optimized according to the current mirror ratio.

Second Embodiment

In the first embodiment, the configuration example in which the normal ignition mode and the soft-off mode are smoothly switched has been described. In a second embodiment of the invention, a configuration example in which the normal ignition mode and a current limiting mode are smoothly switched will be described. The current limiting mode is an operation in which the gate voltage of the switching element 71 is lowered to make a balance such that the current flowing through the primary-side coil 72 is not to exceed a set current limit value.

Figure 4:
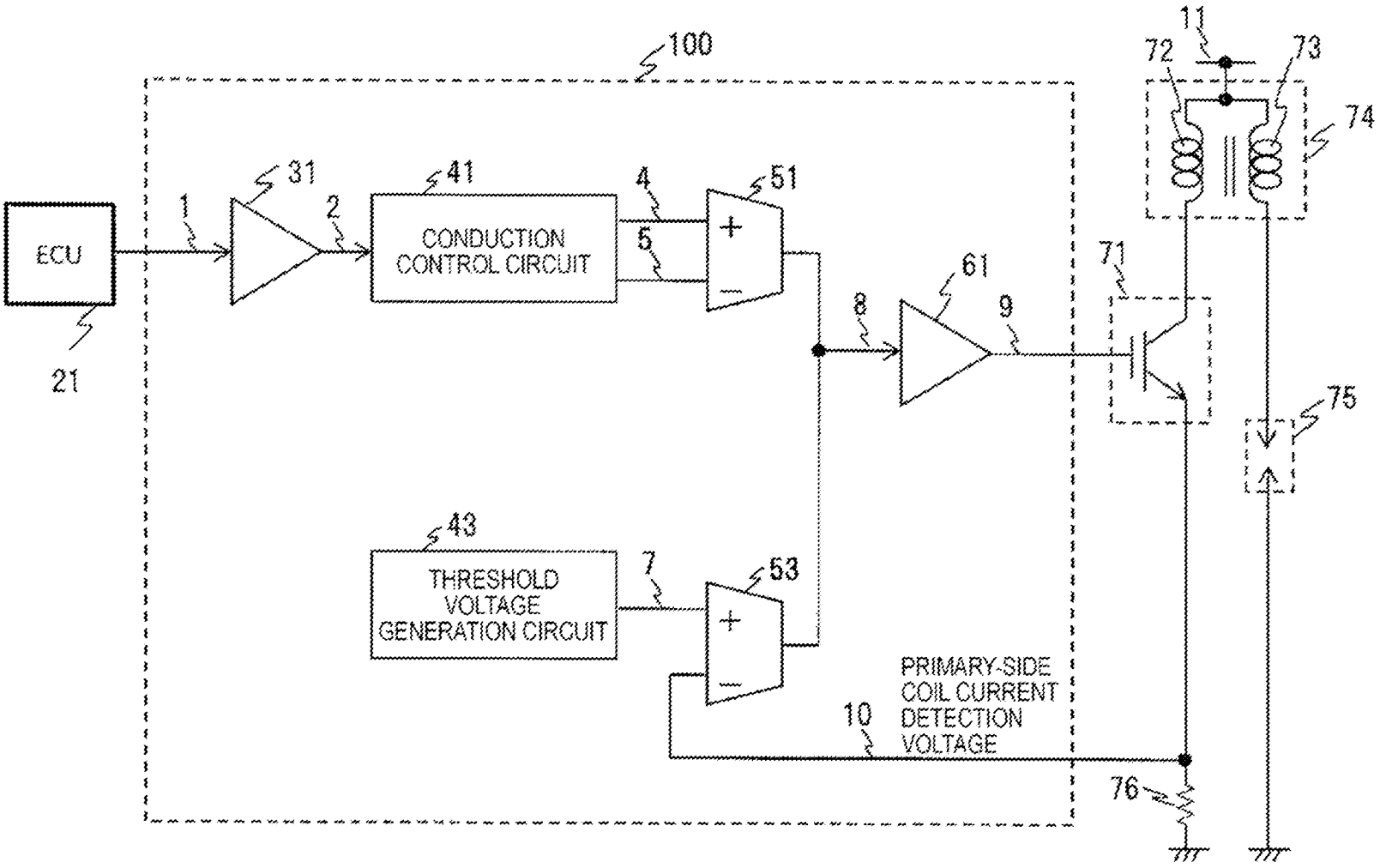
FIG. 4 is a configuration diagram of an internal combustion engine ignition device according to a second embodiment.

FIG. 4 is a configuration diagram of the internal combustion engine ignition device according to the second embodiment. In FIG. 4, a threshold voltage generation circuit 43 is provided instead of the abnormal conduction detection circuit 42 described in the first embodiment and a differential circuit 53 is provided instead of the differential circuit 52. The threshold voltage generation circuit 43 outputs a threshold voltage to the (+) terminal of the differential circuit 53 without depending on the conduction control signal output by the ECU 21. The result of detection of the current flowing through the primary-side coil 72 by a detection resistor 76 is input to the (−) terminal of the differential circuit 53.

Figure 5:
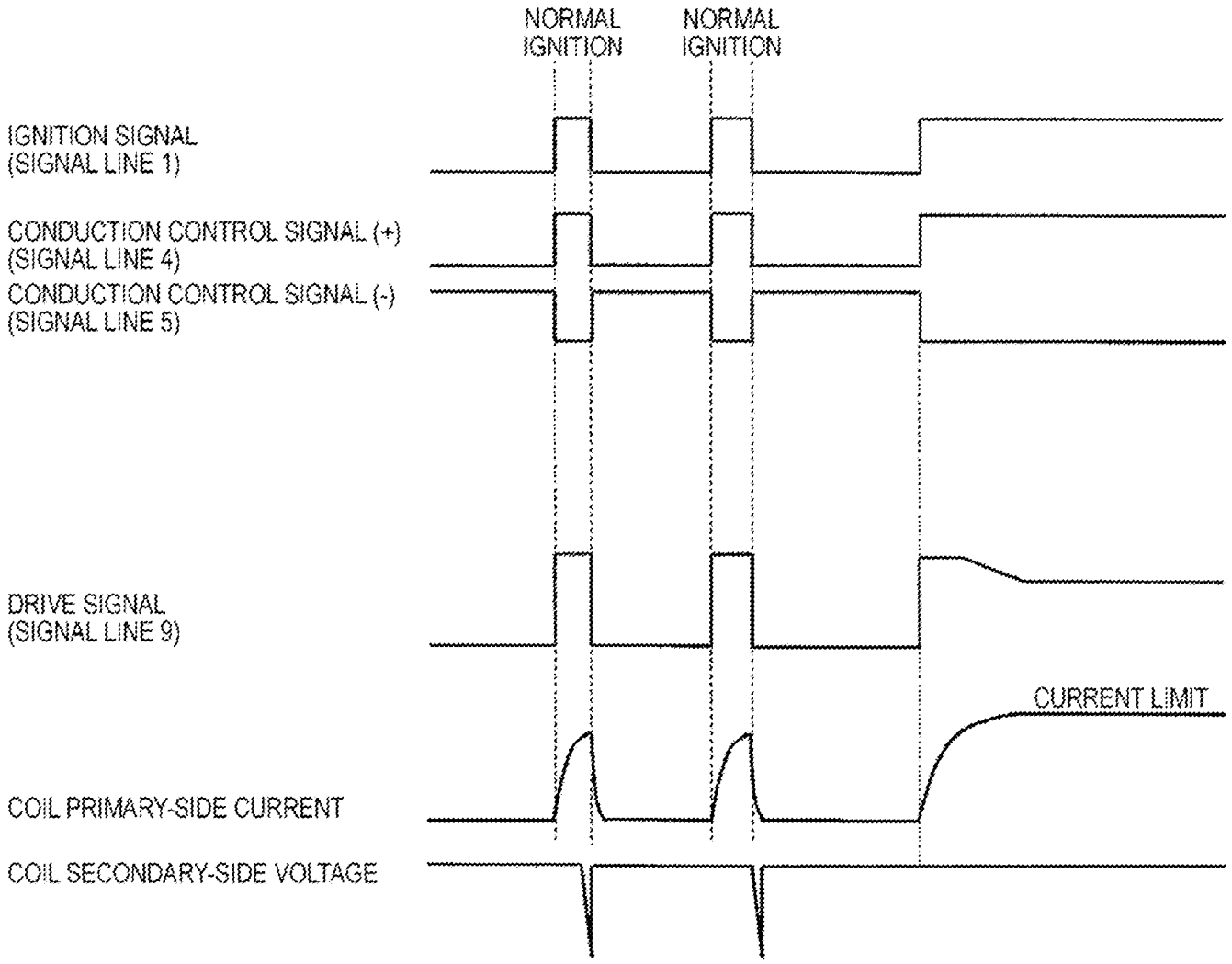
FIG. 5 is a timing chart illustrating an operation of the ignition control device 100 according to the second embodiment.

FIG. 5 is a timing chart illustrating the operation of the ignition control device 100 according to the second embodiment. Hereinafter, the operation in the current limiting mode will be described with reference to the signal waveforms of FIG. 5. The operation in the normal ignition mode is the same as in the first embodiment.

Since the current limiting mode functions while the primary-side coil 72 is conducting, the normal ignition signal is at the Hi level. That is, the signal line 4 is at the Hi level, the signal line 5 is at the Low level, and the signal line 9 is at the Hi level. When the current flowing through the primary-side coil 72 increases, the voltage of a signal line 10 increases.

The differential circuit 53 gradually increases the output current as the voltage of the signal line 10 approaches the voltage of a signal line 7 which is a threshold voltage. This gradually lowers the output of the drive circuit 61 from the Hi level. Since the gate voltage of the switching element 71 decreases when the output of the drive circuit 61 decreases, the current flowing through the primary-side coil 72 decreases. This feedback loop balances each signal and limits the current flowing through the primary-side coil 72 to not exceed the threshold voltage.

Figure 6A:
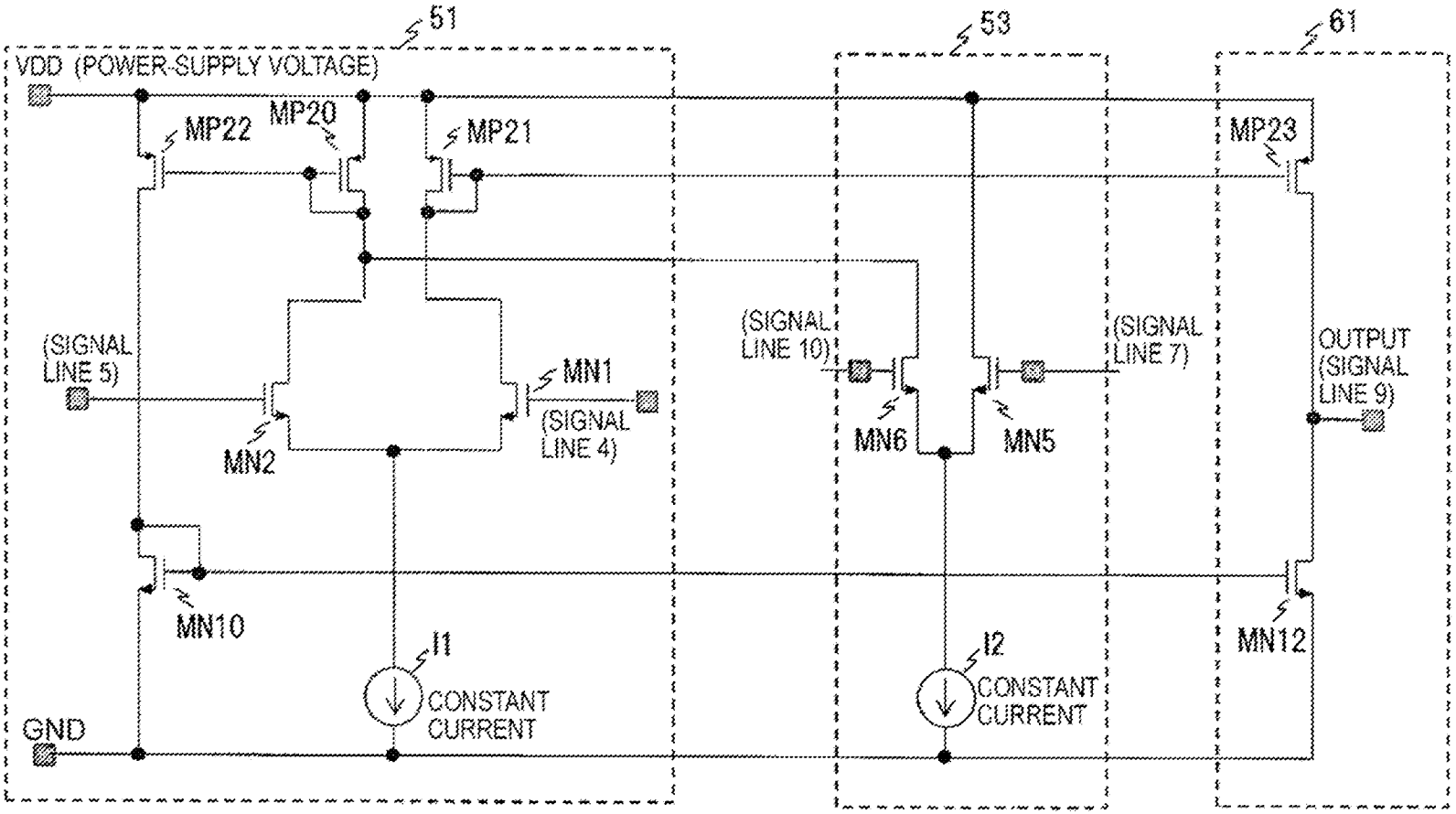
FIG. 6A is a circuit diagram of the differential circuit 51, a differential circuit 53, and the drive circuit 61.

FIG. 6A is a circuit diagram of the differential circuit 51, the differential circuit 53, and the drive circuit 61. The differential circuit 53 includes a constant current source I2, NMOS (MN5, MN6), and PMOS (MP20). The PMOS (MP20) is shared between the differential circuits 51 and 53. A (+) terminal of the differential circuit 53 is a gate terminal of the MN5 and a threshold voltage is input through the signal line 7. The (−) terminal side of the differential circuit 53 is a gate terminal of the MN6 and a detection result of the current flowing through the primary-side coil 72 via the signal line 10 is input.

Figure 6B:
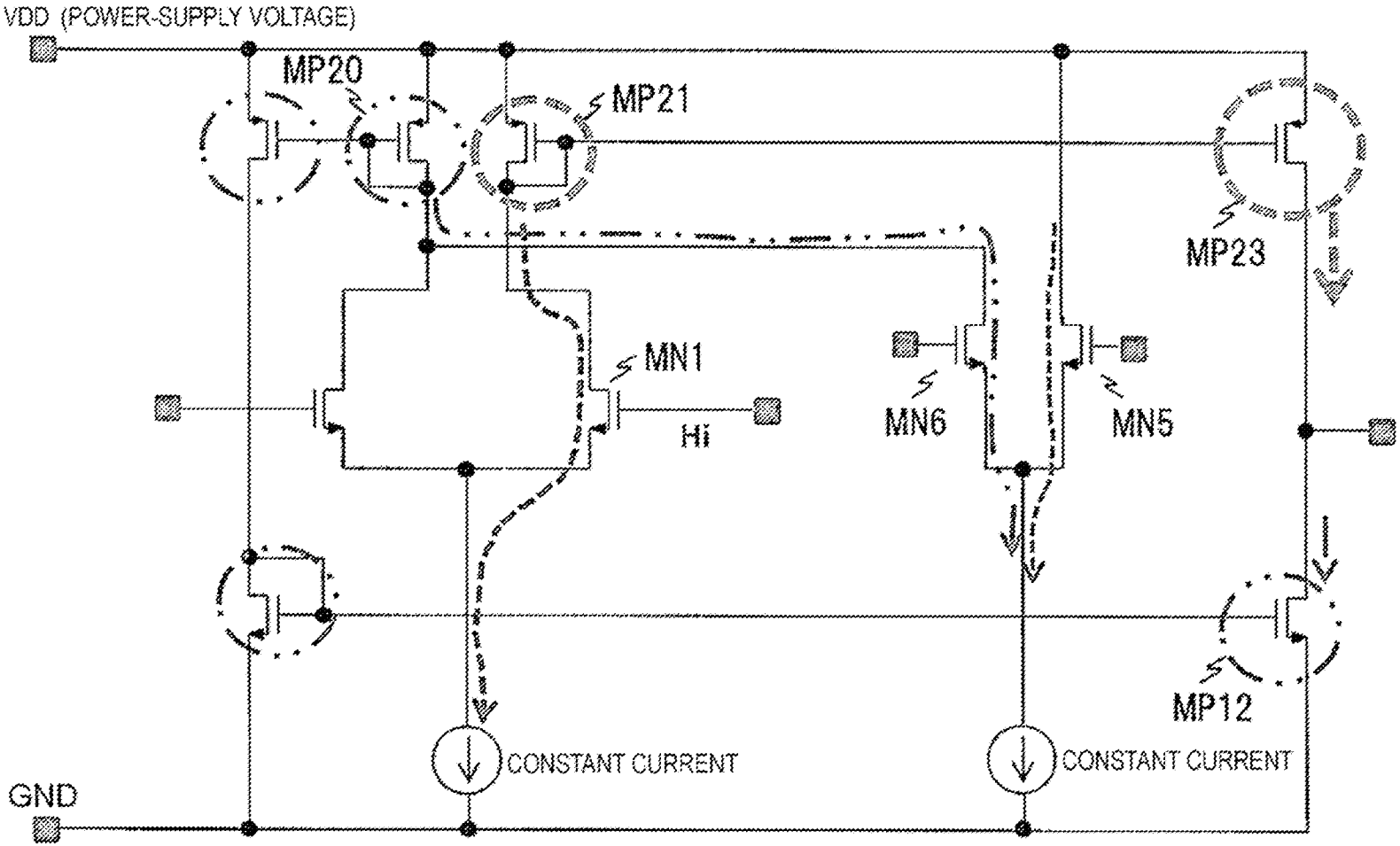
FIG. 6B is a diagram illustrating a smooth transition from the normal ignition mode to the current limiting mode.

FIG. 6B is a diagram illustrating a smooth transition from the normal ignition mode to the current limiting mode. A thick dotted line in FIG. 6B indicates that the output of the drive circuit 61 is formed by the current mirror between the MP21 and the MP23. A dotted line in FIG. 6B indicates the current path in the normal ignition mode. A two-dot chain line in FIG. 6B indicates a current path in the current limiting mode.

In the normal ignition mode, the (+) terminal of the differential circuit 51 is at the Hi level and the current flows to the MP21 side. In the differential circuit 53, the value of the signal line 10 as the detection voltage is smaller than the value of the signal line 7 as the threshold voltage. Therefore, a current flows to the MN5 side and no current flows in a current path from the MN6 to the MP20. In the drive circuit 61, current flows only on the MP23 side and no current flows on the MN12 side.

When the current of the primary-side coil 72 increases and the detection voltage increases, the voltage of the signal line 10 increases. As the voltage of the signal line 10 approaches the threshold voltage (signal line 7), the current flowing in the MN5 decreases and the current flowing in the current path from the MN6 to the MP20 increases. Then, the current determined by the current mirror ratio of the MP20 to the MP22 and the current mirror ratio of the MN10 to the MN12 flows to the MN12 side. This lowers the output (signal line 9) level. When the output (signal line 9) decreases, the gate voltage of the switching element 71 decreases, so that the current of the primary-side coil 72 decreases and the detection voltage (signal line 10) is lowered. This feedback loop balances each signal and limits the current of the primary-side coil 72.

The current of the MN6 increases as the detection voltage increases. However, by gradually changing the MN6 current, the current flowing through the MN12 also changes gently, so that the output (signal line 9) also changes gently. Therefore, it is possible to smoothly shift from the normal ignition mode to the current limiting mode.

Second Embodiment: Summary

The internal combustion engine ignition device according to the second embodiment gradually increases the current flowing to the MN6 when switching from the normal ignition mode to the current limiting mode. Due to the current mirror between the MP20 and the MP22 and the current mirror between the MN10 and the MN12, the current flowing through MN12 gradually increases. As the current flowing through MN12 gradually increases, the output of the drive circuit 61 gradually decreases. Thus, since the drive current does not change sharply at the timing of the mode switching, the mode can be switched smoothly.

The internal combustion engine ignition device according to the second embodiment feeds back the output (specifically, the result of current detection by the detection resistor 76) of the switching element 71 to a minus input terminal of the differential circuit 53. Accordingly, as the current flowing through the primary-side coil 72 increases beyond the threshold voltage, the current flowing through the MN12 gradually increases and the drive current is adjusted to be balanced with the threshold voltage. Therefore, the current limiting mode can be smoothly performed.

Third Embodiment

Figure 7:
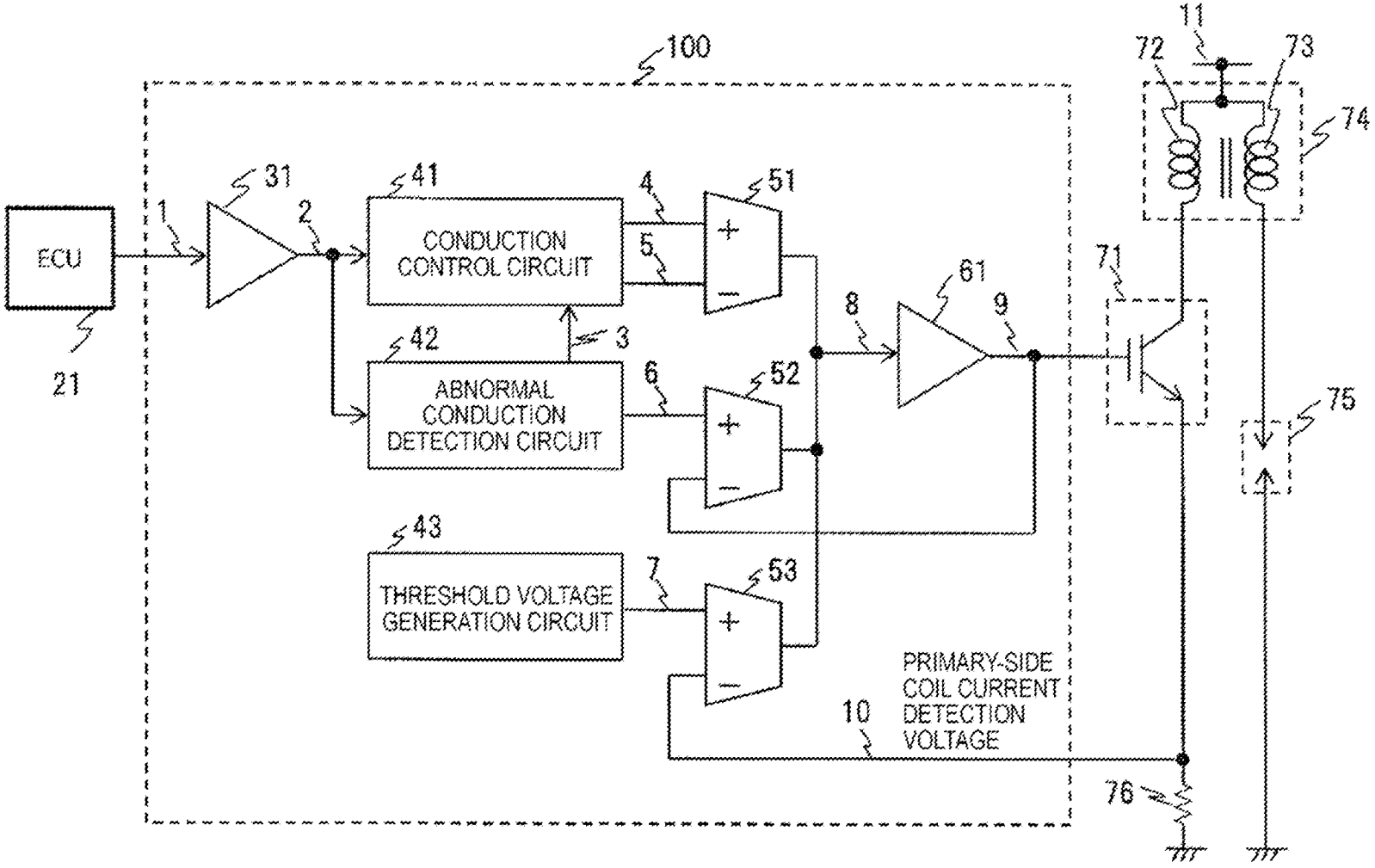
FIG. 7 is a configuration diagram of an internal combustion engine ignition device according to a third embodiment.

FIG. 7 is a configuration diagram of an internal combustion engine ignition device according to a third embodiment of the invention. In the third embodiment, a configuration example in which the first and second embodiments are combined will be described. The description of the same configuration as those of the first and second embodiments will be appropriately omitted. Drive signals from the differential circuit 51, the differential circuit 52, and the differential circuit 53 are input to the drive circuit 61 in parallel.

Figure 8:
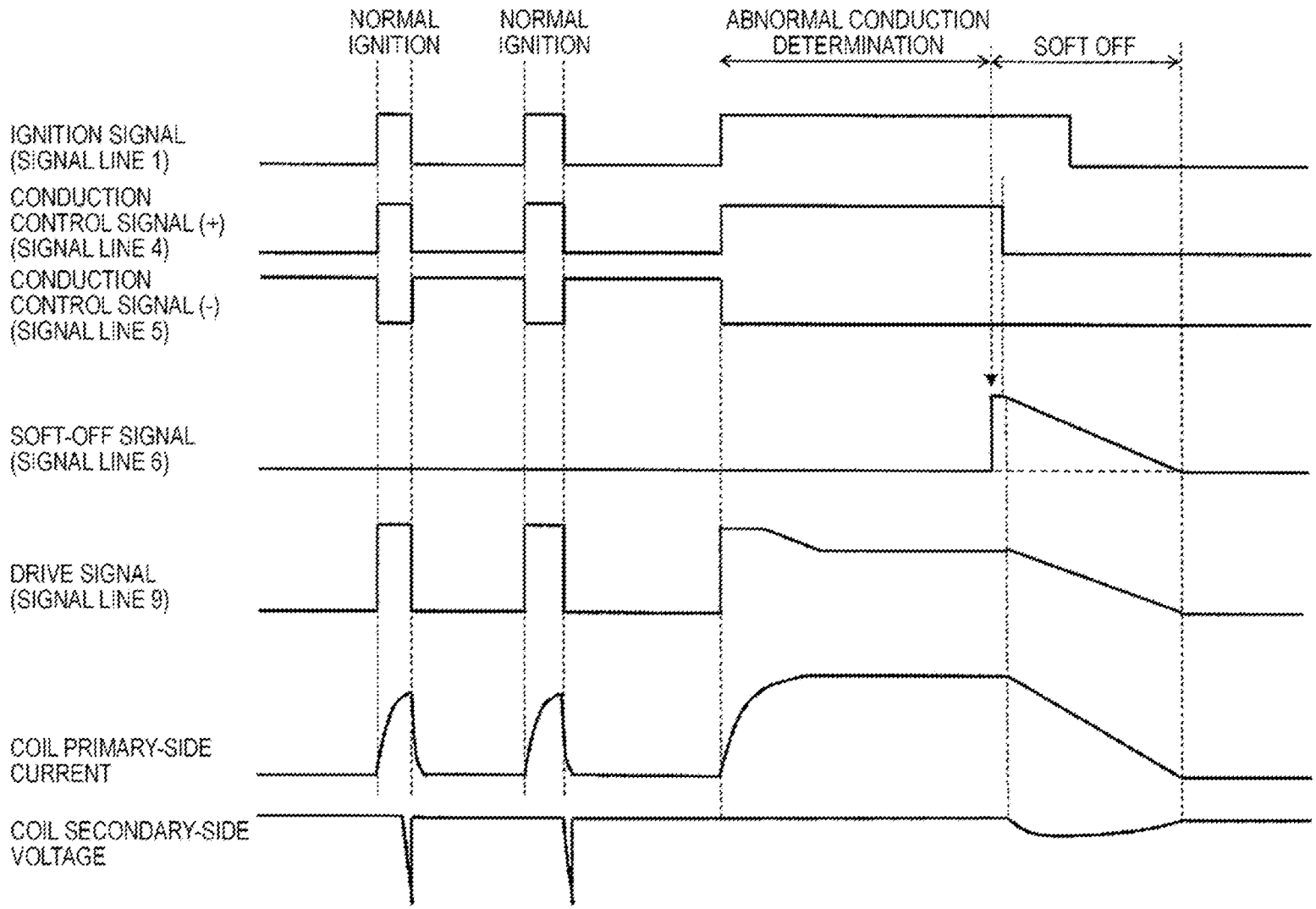
FIG. 8 is a timing chart illustrating an operation of the ignition control device 100 according to the third embodiment.

FIG. 8 is a timing chart illustrating the operation of the ignition control device 100 according to the third embodiment. In the third embodiment, after the transition from the normal ignition mode to the current limiting mode, when the abnormal conduction is continued, the transition is further made to the soft-off mode. The operation procedure in each mode is the same as in the first and second embodiments. When shifting to the soft-off mode during the current limiting mode, the output (signal line 9) gradually changes from the Hi level to the Low level. As a result, the gate voltage of the switching element 71 gradually decreases, so that the current of the primary-side coil 72 gradually decreases. Accordingly, the voltage of the detection voltage (signal line 10) gradually decreases, and thus the current limiting mode ends. Then, the soft-off mode ends.

Figure 9A:
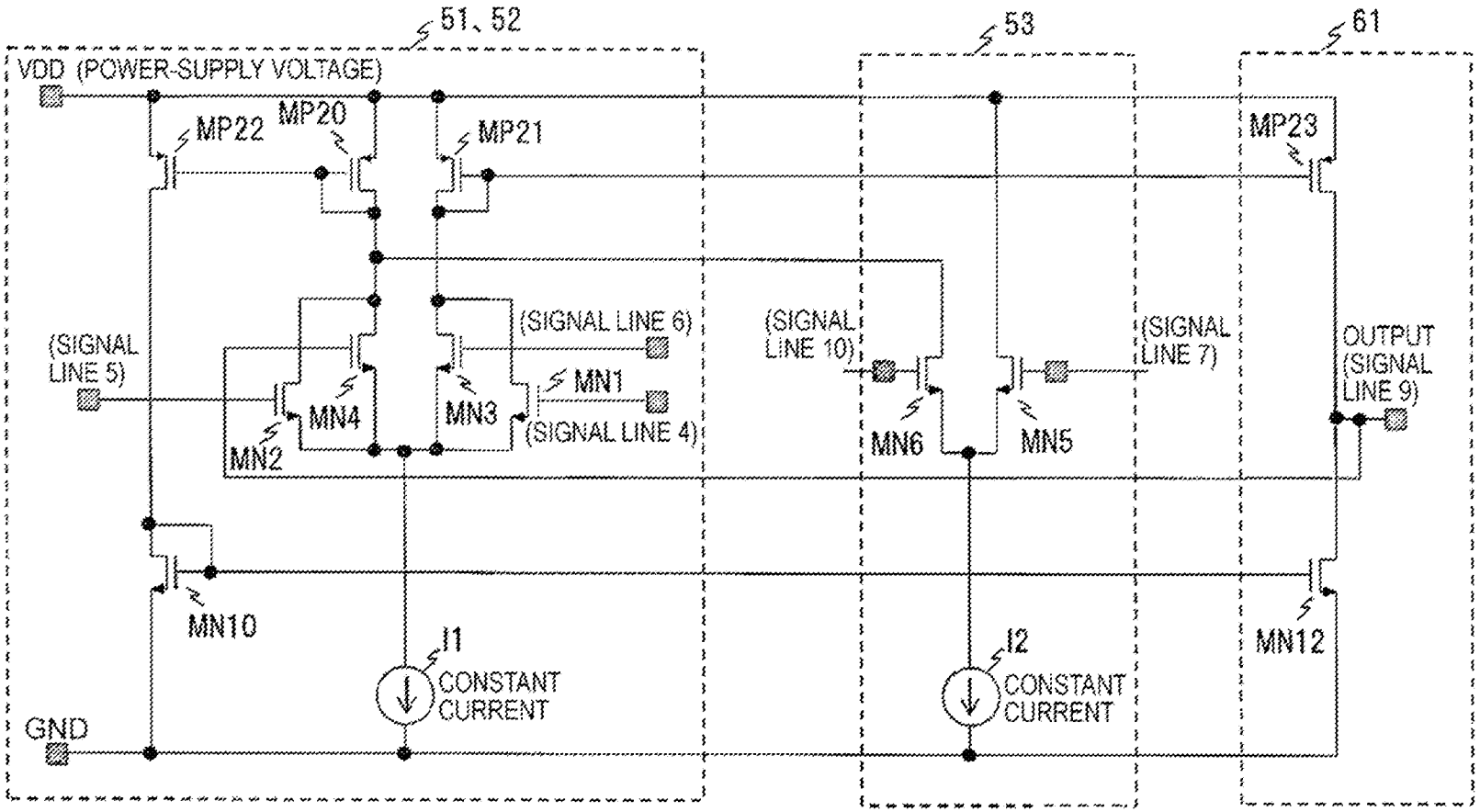
FIG. 9A is a circuit diagram of the differential circuits 51 to 53 and the drive circuit 61.

FIG. 9A is a circuit diagram of the differential circuits 51 to 53 and the drive circuit 61. The configuration of each circuit is the same as those described in the first and second embodiments.

Figure 9B:
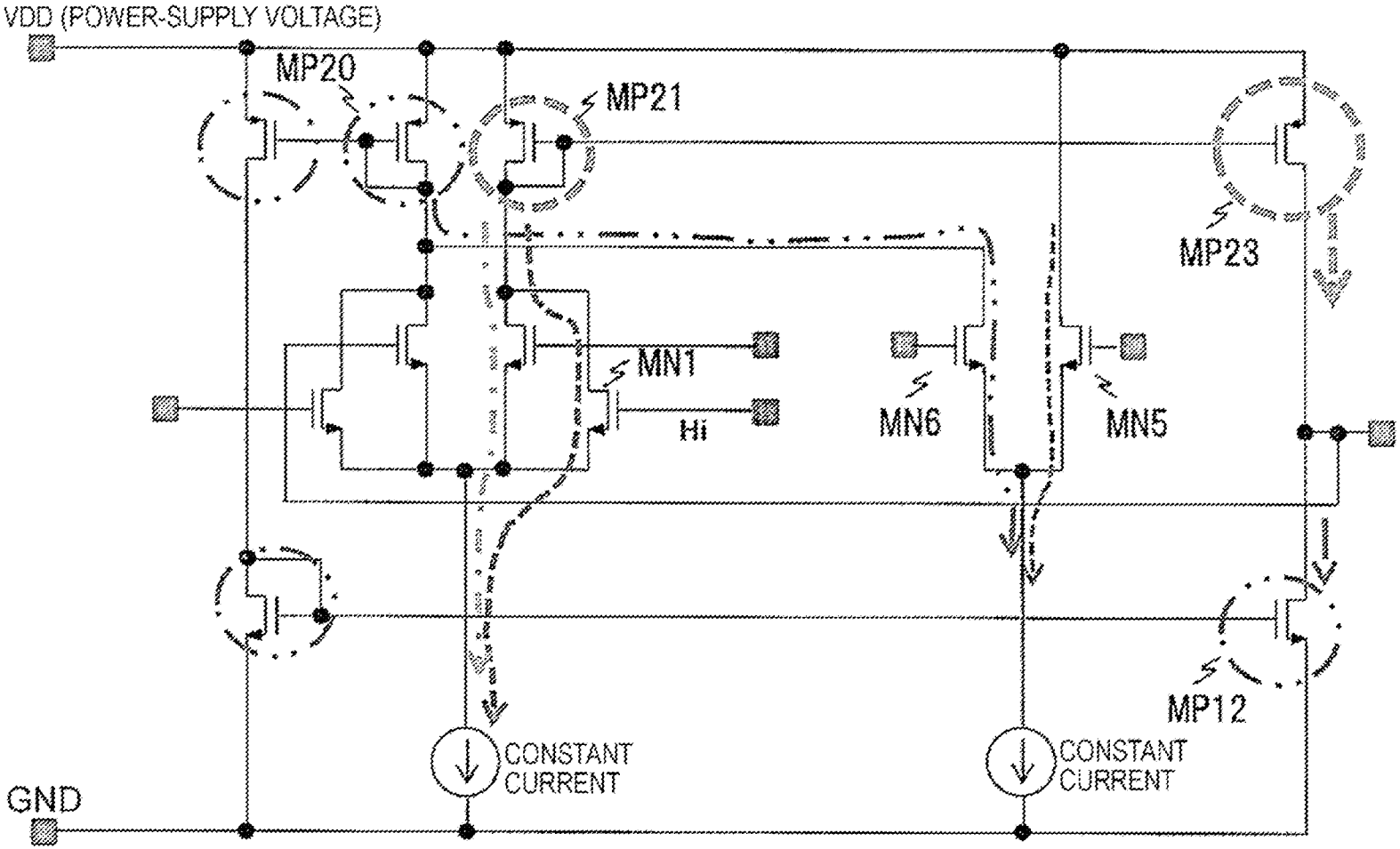
FIG. 9B is a diagram for illustrating flow of a current when shifting from the normal ignition mode to the current limiting mode and further shifting to the soft-off mode.

FIG. 9B is a diagram illustrating flow of a current when shifting from the normal ignition mode to the current limiting mode and further shifting to the soft-off mode. In the normal ignition mode, the (+) terminal (signal line 4) of the differential circuit 51 is at the Hi level and the drive circuit 61 outputs a current from the MP23. When the mode shifts to the current limiting mode, a current corresponding to a current value flowing from the MN6 to the MP20 flows to the MN12 and the output (signal line 9) level is depressed. When shifting to the soft-off mode in this state, the current paths of the differential circuits 51 and 52 are switched from the MN1 side to the MN3 side. Since the current flowing through the MP23 does not change, the output (signal line 9) does not change. When the signal level of the signal line 9 gradually decreases following the soft-off signal waveform, the detection voltage also decreases, so that the current flowing from the MN6 to the MP20 decreases and the current flowing to the MN12 also decreases. Eventually, the stage becomes a state where the current limiting mode is not performed, and then the soft-off mode ends.

Modification Example of the Present Invention

The invention is not limited to the embodiments described above and includes various modification examples. For example, the above-described embodiments have been described in detail for easy understanding of the invention and are not necessarily limited to those having all the configurations described above. A part of the configuration of one embodiment can be replaced with the configuration of another embodiment and the configuration of one embodiment can be added to the configuration of another embodiment. For a part of the configuration of each embodiment, it is possible to add, delete, or replace another configuration.

REFERENCE SIGNS LIST

1 to 10: signal line
11: battery
21: ECU
31: input buffer circuit
41: conduction control circuit
42: abnormal conduction detection circuit
43: threshold voltage generation circuit
51 to 53: differential circuit
61: drive circuit
71: switching element
72: primary-side coil
73: secondary-side coil
74: ignition coil
75: ignition plug
76: detection resistor
I1 to I2: constant current source
MN1 to MN6, MN10, MN12: NMOS transistor
MP20 to MP23: PMOS transistor
100: ignition control device

The invention claimed is:

1. An internal combustion engine ignition device which ignites an internal combustion engine by supplying a drive signal to a drive switch of an ignition circuit, the device comprising:

a drive circuit which outputs the drive signal to the drive switch;

a first differential circuit for operating the drive circuit in a first mode by outputting a first differential signal to the drive circuit; and a second differential circuit for operating the drive circuit in a second mode by outputting a second differential signal to the drive circuit, wherein the first differential circuit and the second differential circuit each include a transistor and are configured such that a drive current for supplying the drive signal flows through the transistor which is common between the first mode and the second mode, the first differential circuit is configured using a first transistor, a second transistor, and a first constant current source, the second differential circuit is configured using the first transistor, a third transistor connected to the first transistor in parallel with the second transistor, and the first constant current source, the first differential circuit outputs the first differential signal by a current flowing through the first transistor, the second transistor, and the first constant current source when operating the drive circuit in the first mode, and the second differential circuit outputs the second differential signal by a current flowing through the first transistor, the third transistor, and the first constant current source when operating the drive circuit in the second mode.

2. The internal combustion engine ignition device according to claim 1, wherein when operating the drive circuit in the first mode, the first differential circuit shuts off the first differential signal after outputting the first differential signal to the drive circuit for a predetermined time, and when operating the drive circuit in the second mode, the second differential circuit forms a signal waveform of the second differential signal such that the drive switch transitions from a conductive state to a cutoff state more slowly than in the first mode.

3. The internal combustion engine ignition device according to claim 1, wherein the internal combustion engine ignition device causes the drive circuit to transition from the first mode to the second mode by conducting the third transistor in a state where the first transistor and the second transistor are conducted, and then shutting off the second transistor.

4. The internal combustion engine ignition device according to claim 1, wherein the internal combustion engine ignition device further includes a first feedback loop for feeding back the output of the drive circuit, and the second differential circuit outputs the second differential signal by using an input signal to the second differential circuit and an output of the drive circuit fed back via the first feedback loop as inputs.

5. The internal combustion engine ignition device according to claim 1, wherein the internal combustion engine ignition device further includes, a conduction control circuit for controlling the first differential circuit, and an abnormal conduction control circuit for controlling the second differential circuit, and upon detecting that the drive switch continued conduction for a predetermined time or more, the abnormal conduction control circuit operates the second differential circuit to output the second differential signal, and then outputs a signal instructing the conduction control circuit to cut off the first differential signal.

6. The internal combustion engine ignition device according to claim 1, wherein the drive circuit includes a first output transistor forming a first current mirror circuit for mirroring a current flowing through the first differential circuit, and the first output transistor outputs a current having a current level corresponding to a mirror ratio of the first current mirror circuit.

7. The internal combustion engine ignition device according to claim 1, wherein the internal combustion engine ignition device further includes a third differential circuit which operates the drive circuit in a third mode by outputting a third differential signal to the drive circuit, the third differential circuit is configured using a fourth transistor, a fifth transistor, and a second constant current source, when operating the drive circuit in the first mode, the third differential circuit allows a first current to flow through the fourth transistor and the second constant current source, and when operating the drive circuit in the third mode, the third differential circuit allows the first current to flow through the fourth transistor and the second constant current source and allows a second current to flow through the fifth transistor and the second constant current source.

8. The internal combustion engine ignition device according to claim 7, wherein when operating the drive circuit in the third mode, the third differential circuit holds an output current of the drive switch to a predetermined current value or less by gradually increasing a ratio of the second current to the first current.

9. The internal combustion engine ignition device according to claim 7, wherein the internal combustion engine ignition device further includes a second feedback loop for feeding back the output current of the drive switch, and the third differential circuit outputs the third differential signal by using an input signal to the third differential circuit and an output of the drive circuit fed back through the second feedback loop as inputs.

10. The internal combustion engine ignition device according to claim 9, wherein the internal combustion engine ignition device further includes, a conduction control circuit for controlling the first differential circuit, and a threshold voltage generation circuit which outputs a threshold voltage to the third differential circuit, the fourth transistor is configured to perform conduction by receiving the threshold voltage, the fifth transistor is configured to perform conduction by receiving a voltage obtained by converting an output current of the drive switch fed back via the second feedback loop, and the second constant current source keeps a sum of the first current and the second current constant.

11. The internal combustion engine ignition device according to claim 7, wherein the drive circuit includes, a first output transistor forming a first current mirror circuit for mirroring a current flowing through the first differential circuit, and a second output transistor forming a second current mirror circuit for mirroring a current flowing through the fifth transistor, the first output transistor outputs a current having a current level corresponding to a mirror ratio of the first current mirror circuit, and the second output transistor outputs a current having a current level corresponding to a mirror ratio of the second current mirror circuit.

12. The internal combustion engine ignition device according to claim 1, wherein the first differential circuit is configured using a first transistor, a second transistor, and a first constant current source, the second differential circuit is configured using the first transistor, a third transistor connected to the first transistor in parallel with the second transistor, and the first constant current source, the first differential circuit outputs the first differential signal by a current flowing through the first transistor, the second transistor, and the first constant current source when operating the drive circuit in the first mode, the second differential circuit outputs the second differential signal by a current flowing through the first transistor, the third transistor, and the first constant current source when operating the drive circuit in the second mode, the internal combustion engine ignition device further includes a first feedback loop for feeding back an output of the drive circuit, the second differential circuit outputs the second differential signal by using an input signal to the second differential circuit and an output of the drive circuit fed back via the first feedback loop as inputs, the internal combustion engine ignition device further includes, a conduction control circuit for controlling the first differential circuit, and an abnormal conduction control circuit for controlling the second differential circuit, upon detecting that the drive switch continued conduction for a predetermined time or more, the abnormal conduction control circuit operates the second differential circuit to output the second differential signal, and then outputs a signal instructing the conduction control circuit to cut off the first differential signal, the internal combustion engine ignition device further includes a third differential circuit which operates the drive circuit in a third mode by outputting a third differential signal to the drive circuit, the third differential circuit is configured using a fourth transistor, a fifth transistor, and a second constant current source, when operating the drive circuit in the first mode, the third differential circuit allows a first current to flow through the fourth transistor and the second constant current source, when operating the drive circuit in the third mode, the third differential circuit allows the first current to flow through the fourth transistor and the second constant current source and allows a second current to flow through the fifth transistor and the second constant current source, the internal combustion engine ignition device further includes a second feedback loop for feeding back an output current of the drive switch, the third differential circuit outputs the third differential signal by using an input signal to the third differential circuit and an output of the drive circuit fed back through the second feedback loop as inputs, the internal combustion engine ignition device further includes, a threshold voltage generation circuit for outputting a threshold voltage to the third differential circuit, the fourth transistor is configured to perform conduction by receiving the threshold voltage, the fifth transistor is configured to perform conduction by receiving an output of the drive switch fed back via the second feedback loop, and the second constant current source keeps a sum of the first current and the second current constant.

13. An internal combustion engine ignition device which ignites an internal combustion engine by supplying a drive signal to a drive switch of an ignition circuit, the device comprising:

a drive circuit which outputs the drive signal to the drive switch;

a first differential circuit for operating the drive circuit in a first mode by outputting a first differential signal to the drive circuit;

a second differential circuit for operating the drive circuit in a second mode by outputting a second differential signal to the drive circuit; and a third differential circuit which operates the drive circuit in a third mode by outputting a third differential signal to the drive circuit, wherein the first differential circuit and the second differential circuit each include a transistor and are configured such that a drive current for supplying the drive signal flows through the transistor which is common between the first mode and the second mode the third differential circuit is configured using a fourth transistor, a fifth transistor, and a second constant current source, when operating the drive circuit in the first mode, the third differential circuit allows a first current to flow through the fourth transistor and the second constant current source, and when operating the drive circuit in the third mode, the third differential circuit allows the first current to flow through the fourth transistor and the second constant current source and allows a second current to flow through the fifth transistor and the second constant current source.

14. The internal combustion engine ignition device according to claim 13, wherein when operating the drive circuit in the third mode, the third differential circuit holds an output current of the drive switch to a predetermined current value or less by gradually increasing a ratio of the second current to the first current.

15. The internal combustion engine ignition device according to claim 13, wherein the internal combustion engine ignition device further includes a second feedback loop for feeding back the output current of the drive switch, and the third differential circuit outputs the third differential signal by using an input signal to the third differential circuit and an output of the drive circuit fed back through the second feedback loop as inputs.

16. The internal combustion engine ignition device according to claim 15, wherein the internal combustion engine ignition device further includes, a conduction control circuit for controlling the first differential circuit, and a threshold voltage generation circuit which outputs a threshold voltage to the third differential circuit, the fourth transistor is configured to perform conduction by receiving the threshold voltage, the fifth transistor is configured to perform conduction by receiving a voltage obtained by converting an output current of the drive switch fed back via the second feedback loop, and the second constant current source keeps a sum of the first current and the second current constant.

17. The internal combustion engine ignition device according to claim 13, wherein the drive circuit includes, a first output transistor forming a first current mirror circuit for mirroring a current flowing through the first differential circuit, and a second output transistor forming a second current mirror circuit for mirroring a current flowing through the fifth transistor, the first output transistor outputs a current having a current level corresponding to a mirror ratio of the first current mirror circuit, and the second output transistor outputs a current having a current level corresponding to a mirror ratio of the second current mirror circuit.

18. An internal combustion engine ignition device which ignites an internal combustion engine by supplying a drive signal to a drive switch of an ignition circuit, the device comprising:

a drive circuit which outputs the drive signal to the drive switch;

a first differential circuit for operating the drive circuit in a first mode by outputting a first differential signal to the drive circuit; and a second differential circuit for operating the drive circuit in a second mode by outputting a second differential signal to the drive circuit, wherein the first differential circuit and the second differential circuit each include a transistor and are configured such that a drive current for supplying the drive signal flows through the transistor which is common between the first mode and the second mode, when operating the drive circuit in the first mode, the first differential circuit shuts off the first differential signal after outputting the first differential signal to the drive circuit for a predetermined time, and when operating the drive circuit in the second mode, the second differential circuit forms a signal waveform of the second differential signal such that the drive switch transitions from a conductive state to a cutoff state more slowly than in the first mode.

* * * * *